US007032890B2

(12) United States Patent
Svalbe

(10) Patent No.: US 7,032,890 B2
(45) Date of Patent: Apr. 25, 2006

(54) PLASTIC FENCE

(76) Inventor: John Svalbe, 2044 Phalarope Ct., Costa Mesa, CA (US) 92626

( * ) Notice: Subject to any disclaimer, the term of this patent is extended or adjusted under 35 U.S.C. 154(b) by 0 days.

(21) Appl. No.: 10/374,212

(22) Filed: Feb. 25, 2003

(65) Prior Publication Data

US 2004/0164287 A1 Aug. 26, 2004

(51) Int. Cl.
*E04H 17/14* (2006.01)

(52) U.S. Cl. ..... 256/21; 256/19; 256/22; 256/65.02; 256/65.08; 256/66; 256/65.01

(58) Field of Classification Search ..... 256/19, 256/21, 22, 24, 25, 59, 65.01, 66, 65.11, 65.02, 256/65.08, 65.12; 29/429, 460
See application file for complete search history.

(56) References Cited

U.S. PATENT DOCUMENTS

| | | | | | |
|---|---|---|---|---|---|
| 1,070,814 | A | * | 8/1913 | Kimball | 5/283 |
| 1,114,486 | A | * | 10/1914 | Kimball | 5/283 |
| 1,441,724 | A | * | 1/1923 | Ferris | 256/22 |
| 2,027,493 | A | | 1/1936 | Thilborger | |
| 3,313,527 | A | * | 4/1967 | Eriksson | 256/65.08 |
| 3,463,456 | A | * | 8/1969 | Walker | 256/22 |
| 3,522,933 | A | * | 8/1970 | Braun | 256/22 |
| 3,614,068 | A | * | 10/1971 | Koehl | 256/19 |
| 3,957,250 | A | | 5/1976 | Murphy | |
| 3,975,000 | A | * | 8/1976 | Sado | 256/59 |
| 4,289,302 | A | | 9/1981 | Montgomery | |
| 4,723,760 | A | * | 2/1988 | O'Sullivan | 256/22 |
| 4,796,866 | A | | 1/1989 | Garneau | |
| 4,809,955 | A | * | 3/1989 | Veilleux | 256/65.02 |
| 4,824,077 | A | | 4/1989 | Brickner | |
| 4,858,891 | A | | 8/1989 | Boes | |
| 4,892,292 | A | | 1/1990 | Russell | |
| 5,255,899 | A | | 10/1993 | von Grozny | |
| 5,302,047 | A | | 4/1994 | Ivey | |

(Continued)

FOREIGN PATENT DOCUMENTS

| | | | | |
|---|---|---|---|---|
| AT | OE32253 | * | 10/1907 | 256/19 |

(Continued)

OTHER PUBLICATIONS

Heritage Vinyl Products—Sable 3 Fence Assembly Instructions, May 1992.

(Continued)

*Primary Examiner*—Daniel P. Stodola
*Assistant Examiner*—Daniel J. Mills

(57) ABSTRACT

The present invention is a thin profile prefabricated reinforced plastic fence. A preferred embodiment of the fence comprises a top rail having a bottom side with a plurality of picket apertures and a bottom rail having a top side with a plurality of member apertures. The bottom rail preferably contains a horizontal strengthening member and supports the top rail by way of vertical pickets. Each picket sheaths a strengthening member that is slideable inside the picket. The top of each picket is inserted into the picket apertures of the top rail and the strengthening member extends from the bottom of each picket into the member aperture of the bottom rail. The bottom of each picket rests upon the top side of the bottom rail. The fence ends have a first post and second post to which the top and bottom rails are fastened.

30 Claims, 3 Drawing Sheets

U.S. PATENT DOCUMENTS

| | | | | | |
|---|---|---|---|---|---|
| 5,303,900 | A | | 4/1994 | Zulick, III et al. | |
| 5,404,685 | A | | 4/1995 | Collins | |
| 5,572,845 | A | * | 11/1996 | DeSouza | 52/664 |
| 5,613,664 | A | * | 3/1997 | Svalbe | 256/19 |
| 5,868,382 | A | * | 2/1999 | Groves | 256/73 |
| 5,938,184 | A | * | 8/1999 | DeSouza | 256/19 |

FOREIGN PATENT DOCUMENTS

| | | | | | |
|---|---|---|---|---|---|
| DE | 1924100 | | * | 11/1970 | 256/24 |
| NL | EP 0381289 | A1 | * | 8/1990 | |

OTHER PUBLICATIONS

Heritage Fence—Brochure, Jan. 1992.

Heritage Vinyl Products—General Installation of Residential Fence.

Heritage Fence—Brochure.

Heritage Fence—Semi-Private and Privacy Fence, Feb. 1992.

Heritage Fence, The Need to Know, Product Specification.

* cited by examiner

PLASTIC FENCE

BACKGROUND OF THE INVENTION

1. Field of the Invention

The present invention is an improved plastic fence. In particular, it is directed to a thin profile prefabricated reinforced plastic fence.

2. Description of Related Art

Generally, plastic fences are known and described in U.S. Pat. Nos. 4,289,302, 4,796,866, 4,858,891, 5,404,685, and 5,255,899, for example. Moreover, Applicant is the inventor of U.S. Pat. No. 5,613,664, the disclosure of which is fully incorporated herein by reference.

Typically, plastic fences are constructed of large fence members and used for corral type applications. Common prior art fences have three or four horizontal and vertical posts and no vertical pickets. When pickets are used, the members are overly large due to the relative lack of strength and sturdiness in plastics as compared to other fencing materials such as metal or wood. Often, plastic fences are too large and heavy to be sold as prefabricated fences. Also, plastic fences frequently need to be filled with a hardening agent such as concrete to strengthen the fence. Thus, a thin profile, lighter, sturdier plastic fence that can be sold prefabricated and does not require a hardening agent is desired.

SUMMARY OF THE INVENTION

The present invention is a thin profile prefabricated reinforced plastic fence. A preferred embodiment of the fence comprises a top rail having a bottom side with a plurality of picket apertures and a bottom rail having a top side with a plurality of member apertures. The top and bottom rails preferably contain a centering dowel and the bottom rail preferably contains a horizontal strengthening member with a Z-shaped cross-section. The fence has a plurality of pickets placed between the top rail and bottom rail. Each picket sheaths a strengthening member, preferably of metal, that is allowed to slide inside the picket. The top of each picket is inserted into the picket apertures of the top rail and the strengthening member is allowed to slide out and extend from the bottom of the pickets into the member apertures of the bottom rails. The bottom of each picket rests on the top side of the bottom rail and covers the member aperture. The fence ends are adjacent a first post and second post to which the top and bottom rails are attached.

BRIEF DESCRIPTION OF THE DRAWINGS

The objects and features of the present invention, which are believed to be novel, are set forth with particularity in the appended claims. The present invention, both as to its organization and manner of operation, together with its objects and advantages, may best be understood by reference to the following description, taken in connection with the accompanying drawings, wherein like reference numbers represent like structures and wherein:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to an improved plastic fence.

Figure 1:
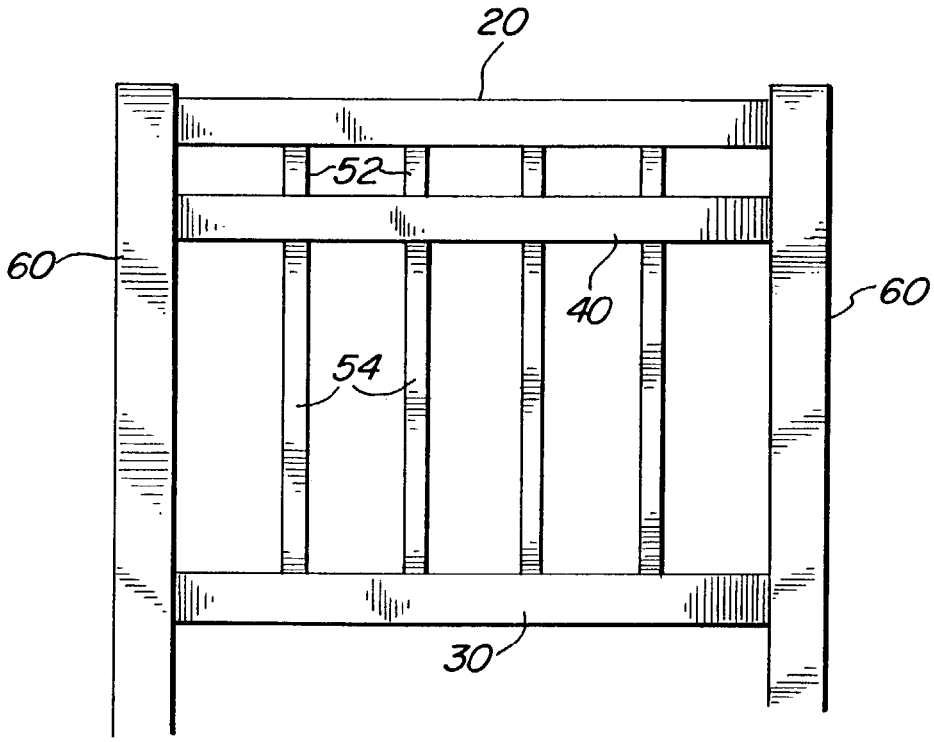
FIG. 1 is a side view of a preferred embodiment of the invention with a top rail.

Referring now to FIG. 1, a preferred embodiment of a section of fence 10 constructed according to the present invention is shown. The invention 10 is a section of fence comprising a top rail 20, a bottom rail 30, a mid-rail 40, a plurality of pickets 50, and a pair of posts 60. These parts are all preferably thin profile components made from extruded plastic such as polyvinyl chloride (PVC) or polypropylene.

The top rail 20 and the mid-rail 40 have a bottom side with a plurality of picket apertures 25. See FIG. 7. The bottom rail 30 and the mid-rail 40 have a top side with a plurality of member apertures 35. See FIG. 8. Each picket aperture 25 in the top rail 20 and each member aperture 35 in the bottom rail 30 corresponds to one of a plurality of pickets 50 between a pair of rails 20, 30. By way of example, four pickets 50 are shown in FIG. 1.

The mid-rail 40 is an optional bottom side rail used for aesthetic purposes or to add strength to the fence as described below. The mid-rail 40 has apertures on the top and the bottom side. The mid-rail 40 has picket apertures 25 on the top side and has member apertures 35 on the bottom side.

Figure 7:
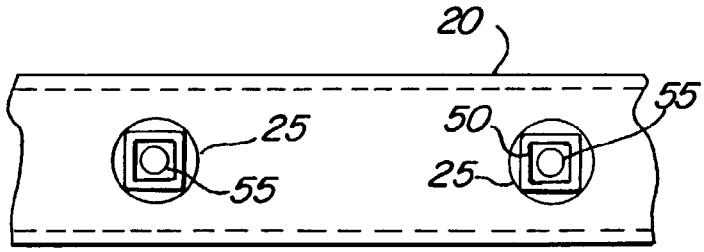
FIG. 7 is a plan view of a portion of a top rail showing a preferred embodiment of the picket apertures.
Figure 8:
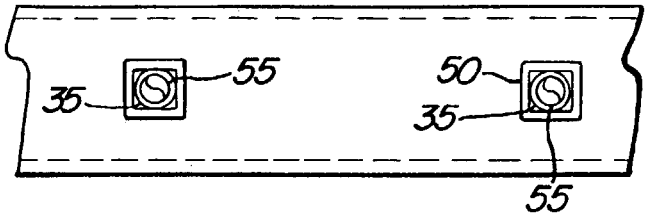
FIG. 8 is a plan view of a portion of a bottom rail showing a preferred embodiment of the picket apertures.

A picket strengthening member 55, as shown in FIGS. 7 and 8, passes through the mid-rail 40.

Figure 2:
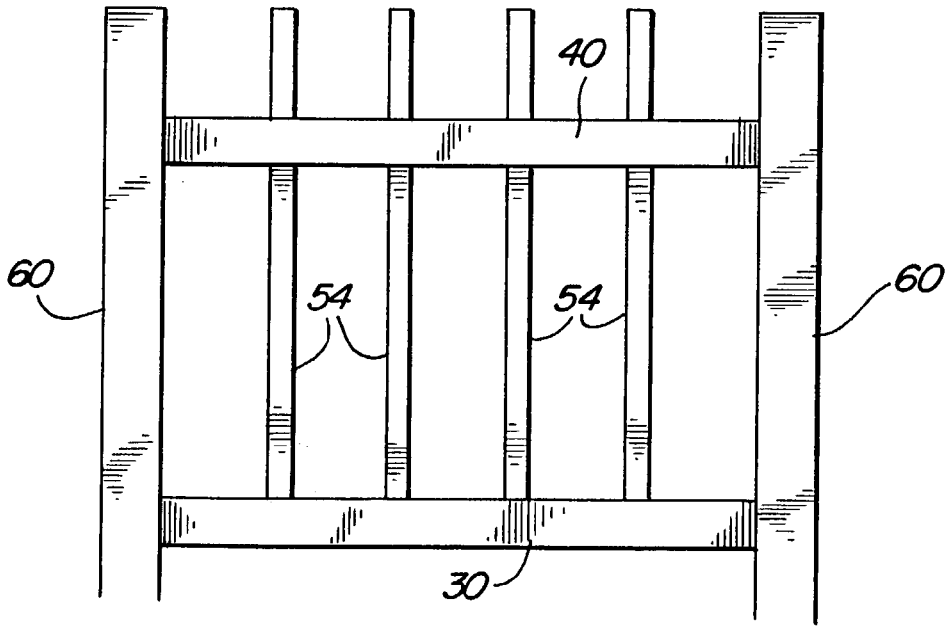
FIG. 2 is a side view of a preferred embodiment of the invention with a picket top configuration.

In an alternate form, the fence may not use a top rail 20 as shown in FIG. 2. Here the top rail with pickets 52 extending upward from rail 40 becomes pickets 54 extending between rail 40 and bottom rail 30.

Figure 5:
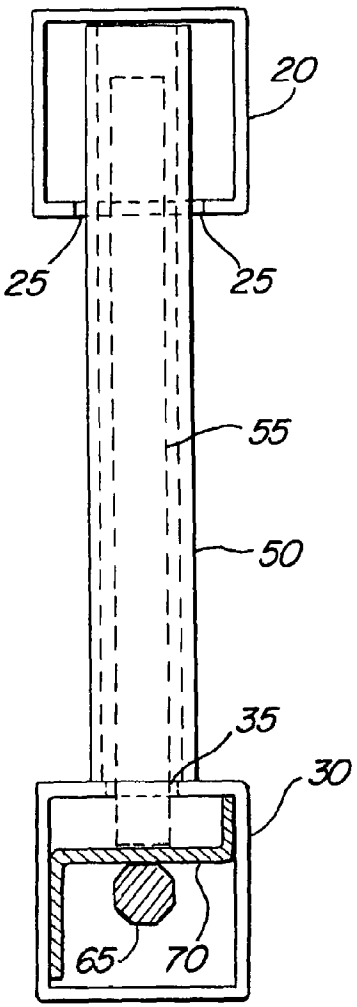
FIG. 5 is a cross-sectional view of a picket and rail embodiment of the invention with a two rail configuration.
Figure 3:
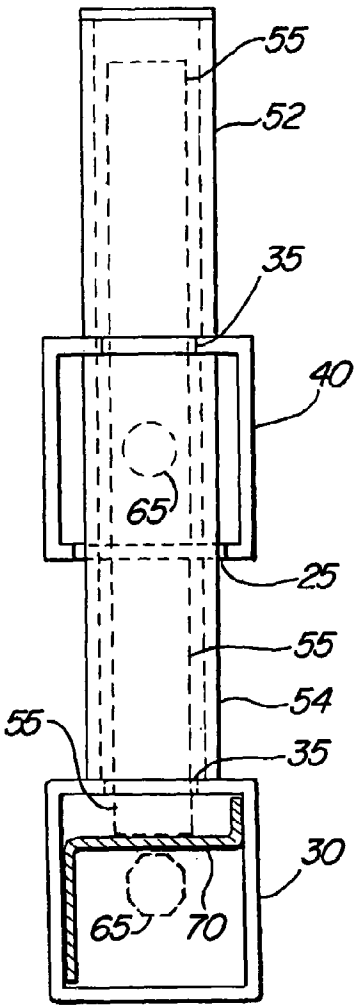
FIG. 3 is a cross-sectional view of a picket and rail embodiment of FIG. 2.

Referring to FIGS. 3 and 5, an end view of a single picket 50 installed in a two-rail, picket top configuration (FIG. 3) and a two rail configuration (FIG. 5) are shown. Referring to FIG. 5, when assembled, the top of the picket 50 is inserted into a picket aperture 25 of the top rail 20 thus locking into place (position) the top end of the picket 50 while the bottom of the picket 50 abuts or rests upon the top side of the bottom rail 30. The picket 50 sheathes a picket strengthening member 55 shown by hidden lines in FIG. 5. The picket strengthening member 55 moves inside the picket 50. The picket strengthening member 55 is preferably a steel tube or rod. The picket strengthening member 55 can be round or square, or any other convenient shape in cross section. The vertical picket strengthening member 55 traverses the distance between the top and bottom rails 20, 30 and drops through the member aperture 35 of the bottom rail 30 to rest upon a horizontal strengthening member 70 located in the bottom rail 30. Thus, the picket strengthening member 55 provides two functions: 1) strengthen the picket 50, and 2) lock into place (position) the bottom of the picket 50 on the bottom rail 30 at bottom member aperture 35.

Figure 4:
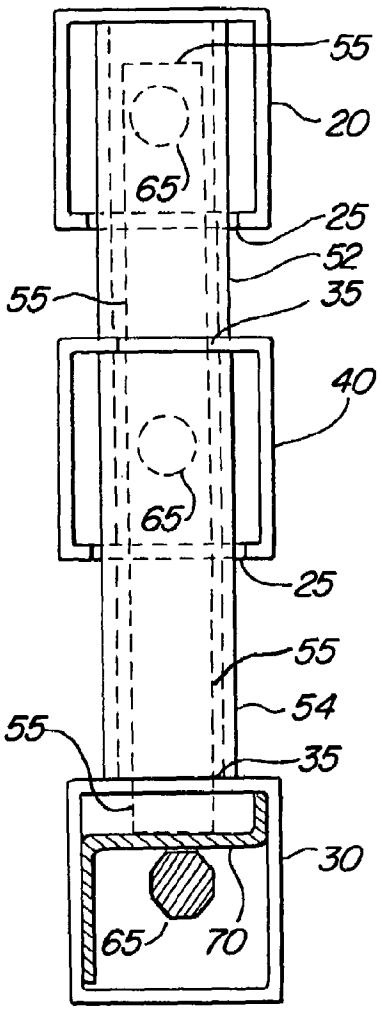
FIG. 4 is a cross-sectional view of a picket and rail embodiment of FIG. 1.

Referring now specifically to FIG. 4, an end view of a picket 50 segmented into parts 52 and 54 is shown installed between three rails, a top rail 20, a bottom rail 30, and a mid-rail 40. The concept of the pickets being held in position by picket apertures 25, member apertures 35 and picket strengthening members 55 extending from the top rail 20, running through the mid-rail 40 and coming to rest through member aperture 35 in the bottom rail 30 is clearly illustrated.

Referring now specifically to FIG. 3, an end view of a picket segmented into parts 52 and 54 and installed in a two-rail configuration is shown. Picket 52 sits atop a mid-rail structure 40 and utilizes the picket strengthening member 55. No top rail is used. A picket strengthening member 55 runs through the top picket segments 52, through the mid-rail 40, the bottom picket segments 54, in the bottom rail 30 through member aperture 35 and rests upon a horizontal strengthening member 70 in the bottom rail 30. Picket 54 situated between mid-rail 40 and bottom rail 30, as shown, is installed similar to picket segment 52.

Referring to FIGS. 3, 4, 5, and 6, an added feature is the location of the bottom horizontal strengthening member 70 located just above the connecting dowel 65. If pressure is applied to the bottom rail 30, the stiffening or strengthening member 70 prevents the bottom rail 30 from sagging. The connecting dowel 65 inserted in post 60 through aperture 62 prevents the bottom rail 30 from being displaced (moving out of position). In similar fashion, the top rail 20 and a mid-rail 40 are also secure in position by use of a spacer 80 (see FIG. 9) which holds the connecting dowel 65 and the rail in position.

Figure 6:
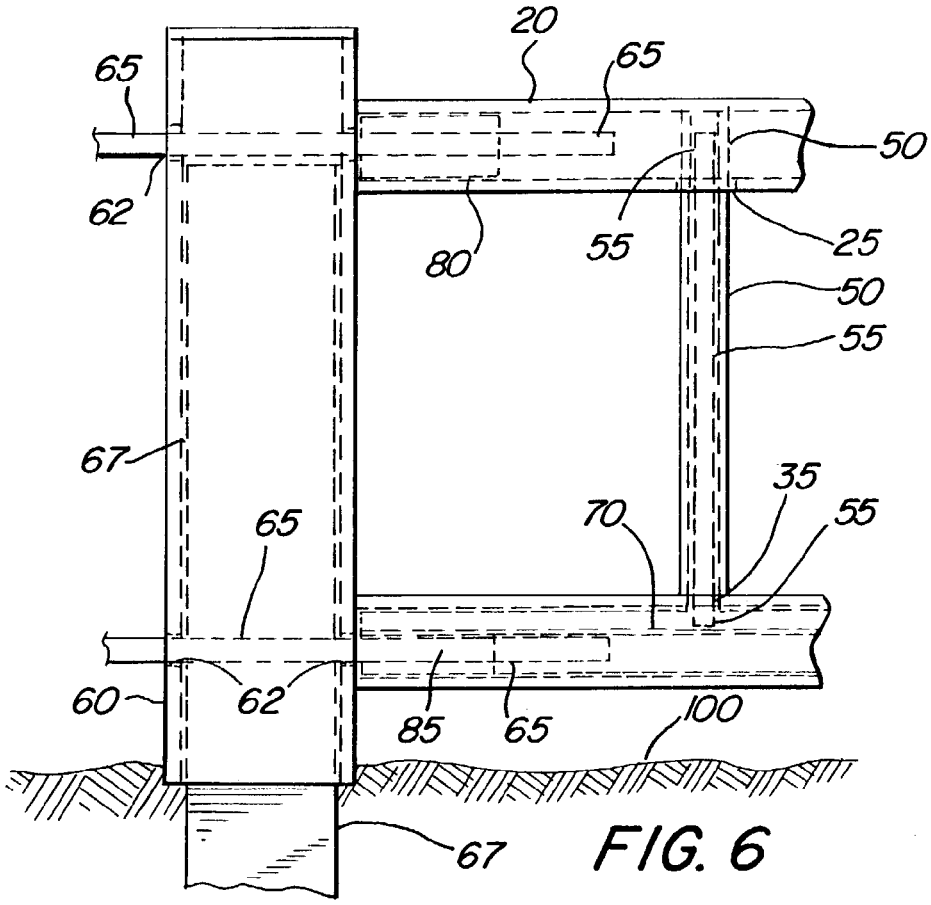
FIG. 6 is a cross-sectional view of a post end pair of rails showing a preferred embodiment for connecting a top and bottom rail to a post.

Referring to FIG. 6, the centering dowel 65 placed through post apertures 62 in the posts 60 and placed into the horizontal rails 20, 30 or 40 through spacers 80 in the top rails and 85 in the bottom rails locks the fence section 10 into place between two posts 60. Once installed between a pair of posts 60, the fence is difficult to move out of position. This is true for all terrain conditions, level, slanted or undulating, for example. For terrains that are less than flat, the rails are attached at appropriate bias angles to the post to conform to the sloping ground.

The top rail 20, as shown in FIGS. 4 and 5, is preferably hollow and allows the picket 50 to pass through the picket aperture 25 to support the top rail 20 from within. This helps prevent the top rail 20 from sagging along its span between its posts 60. However, the bottom rail 30 preferably further incorporates a horizontal strengthening member 70 to strengthen the bottom rail 30 and support the picket strengthening members 55 that pass through the member apertures 35 in bottom rail 30. The horizontal strengthening member 70 preferably has a Z-shaped cross-section as shown in FIG. 2. The member 70 is preferably made of metal.

The member apertures 35 of the preferred embodiment, as shown in FIGS. 3, 4 and 5, is smaller than the picket aperture 25 in the top rail 20. Therefore, the bottom of the picket 50 rests on the top side of bottom rail 30 while the strengthening member 55 passes from the picket 50 through the picket member aperture 35 into the bottom rail 30 and rests on the horizontal strengthening member 70. Thus, a picket 50 and its strengthening member 55 support and stiffen the top and bottom rails 20, 30. The difference in the apertures 25, 35 is best seen in FIGS. 7 and 8.

Figure 9:
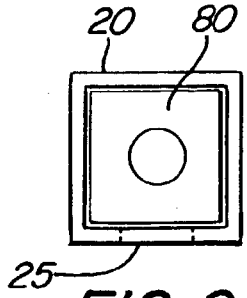
FIG. 9 is a cross-sectional view of a preferred embodiment of a top rail showing a top rail centering spacer.
Figure 10:
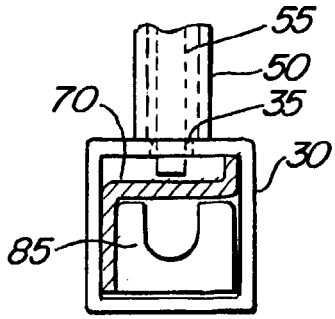
FIG. 10 is a cross-sectional view of a preferred embodiment of a bottom rail showing a cross-section of Z-shaped horizontal strengthening member and a bottom rail centering spacer.

Referring to FIG. 6, a side cross-sectional view of a top rail 20 and a bottom rail 30 as connected to a post 60 is shown. In particular, a centering dowel 65 is held firmly in place within the top rail 20 by spacer 80. In similar fashion in a mid-rail 40 is held in place by a similar spacer 80 (now shown). A bottom rail uses a modified spacer 85. The spacer 80 used for a top rail fills the end of the top rail 20 and mid-rail 40 and thus prevents either the top or mid-tail 20, 40 from moving out of place or position. In similar fashion, the bottom rail 30 is held in place or position by a spacer 85. Both spacers 80, 85 provide space for the insertion of a centering dowel 65. The top rail, mid-rail spacer is best illustrated in FIG. 9. The bottom rail spacer is best illustrated in FIG. 10. The dowel 65 then passes through the end of the rails 20, 30 into a post 60 through a post aperture 62. The aperture 62 can either terminate in the post 60 or pass through the post 60 so that the dowel 65 can connect to another set of top and bottom rails 20, 30 to extend the fence 10. The dowel 65 is preferably made of metal and can be solid or tubular and can have a variety of cross-sections such as round or square, for example.

The posts 60 are preferably hollow and sheath a vertical reinforcement member 67. The vertical member 67 is preferably metal and can vary in cross-sectional shape and volume. The vertical member 67 can extend past the bottom of the post 60 into the ground 100 (FIG. 6) or into a post foundation or footing to provide additional strength, support, and anchoring for the fence 10.

FIG. 4 shows the use of a mid-rail 40 on the fence 10. As previously discussed, the pickets 50 traverse between the top and bottom rails 20, 30. However, when a mid-rail 40 is employed, the pickets 50 are segmented into parts, 52 and 54. The segments 52 and 54 still sheath the picket strengthening member 55. The top segment 52 is inserted into the picket aperture 25. However, the bottom of the top segment 52 rests on the top side of the mid-rail 40. The picket strengthening member 55 passes through the mid-rail 40 through picket aperture 25 and member aperture 35 strengthening the mid-rail 40. The bottom segment 54 of the picket 50 is inserted into the bottom side of the mid-rail 40 through picket aperture 25. The bottom of the bottom segment 54 rests on the top side of the bottom rail 30, while the strengthening member passes into the bottom rail 30 through the member aperture 35. The ends of the mid-rail 40 can be attached to the posts 60 by centering dowels 65 just as the top rail 20 is attached as disclosed in FIG. 4. Thus, the mid-rail 40 is supported by the segmented picket 54 and also provides additional lateral support to the fence 10.

Thus, an improved plastic fence is described above that is relatively sturdy and durable and comprises a simplified construction that permits prefabrication for installation by homeowners. Moreover, no hardening agent such as concrete is required. Furthermore, the use of interlocking members eliminates the need for fasteners such as nails, screws, brackets or rivets to keep the posts of the fence and the fence sections together. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An apparatus including a section of fence, the section of a fence comprising:

a top rail having a bottom side with a plurality of picket apertures;

a bottom rail having a top side with a plurality of member apertures;

a plurality of pickets having a top and a bottom placed between the top rail and bottom rail, the top of each picket inserted into one picket aperture of the top rail and the bottom resting upon the bottom rail;

a plurality of picket strengthening members, each strengthening member extending from the top of a picket to the bottom of the picket and into a member aperture of the bottom rail;

the top rail being supported from within by the top of at least one of the plurality of pickets;

the bottom rail being elongated and comprising a cavity extending along the length of the bottom rail;

a reinforcing member comprising a horizontal and substantially planar segment extending through the bottom rail; and an end of each of the plurality of picket strengthening members resting upon, but being not fastened to, the reinforcing member.

2. The section of the fence of claim 1 where the top rail, bottom rail and plurality of pickets are made of plastic.

3. The section of the fence of claim 2 where the top rail, bottom rail and plurality of pickets are made of polyvinylchloride (PVC).

4. The section of the fence of claim 1 where the bottom rail further comprises a centering dowel.

5. The section of the fence of claim 1 further comprising a mid-rail mounted between the top rail and the bottom rail where the strengthening member of at least one picket extends through the mid-rail.

6. The section of the fence of claim 5 where each picket comprises at least two pieces separated by the mid-rail.

7. The section of fence of claim 1 wherein each picket contains a strengthening member, inserted into the picket and member aperture in the bottom rail upon assembly of the fence section.

8. The section of the fence of claim 1 where the top rail and bottom rail are each mounted between two vertical posts.

9. The section of the fence of claim 7 where the bottom rail further comprises a centering dowel extending into each vertical post.

10. The apparatus of claim 1 wherein the apparatus is a fence comprising:

a first post having a top and bottom where the top rail is fastened to the top of the first post and the bottom rail is fastened to the bottom of the first post; and a second post having a top and bottom where the top rail is fastened to the top of the second post and the bottom rail is fastened to the bottom of the second post.

11. The fence of claim 10 where the top rail, pickets, first post and second post are made of plastic and where the picket strengthening member and horizontal strengthening member are made of metal.

12. An apparatus including a section of fence, the section of a fence comprising:

a top rail having a bottom side with a plurality of picket apertures;

a bottom rail having a top side with a plurality of member apertures;

a plurality of pickets having a top and a bottom placed between the top rail and bottom rail, the top of each picket inserted into one picket aperture of the top rail and the bottom resting upon the bottom rail; and a picket strengthening member extending from the top of a picket to the bottom of the picket and into a member aperture of the bottom rail; wherein the top rail is supported from within by the top of at least one of the plurality of pickets;

wherein the apparatus is a fence comprising:

a horizontal strengthening member having a Z-shaped cross-section located inside the bottom rail;

a first post having a top and bottom where the top rail is fastened to the top of the first post and the bottom rail is fastened to the bottom of the first post; and a second post having a top and bottom where the top rail is fastened to the top of the second post and the bottom rail is fastened to the bottom of the second post.

13. The fence of claim 12 further comprising a centering spacer in the bottom rail.

14. The fence of claim 13 further comprising a centering dowel extending from one end of the bottom rail to the other end supported by the centering spacer.

15. The fence of claim 12 further comprising a centering dowel extending from one end of the bottom rail through a post to an end of another bottom rail adjoining the post.

16. The fence of claim 12 further comprising a centering dowel in the top rail extending from one end of the top rail through a post to an end of another top rail adjoining the post.

17. The fence of claim 16 further comprising a centering spacer in the top rail for supporting the centering dowel in the top rail.

18. The fence of claim 16 further comprising a centering spacer in a mid-rail for supporting the centering dowel in the mid-rail.

19. The fence of claim 12 wherein the picket apertures are larger than the member apertures.

20. The fence of claim 14 wherein the centering dowel extends from the bottom rail into the first and second posts.

21. The fence of claim 12 further comprising a mid-rail mounted between the top rail and bottom rail;

a top picket segment above the mid-rail;

a bottom picket segment below the mid-rail; and a strengthening member extending from the top of the top picket segment through the mid-rail to the bottom of the bottom picket segment.

22. The fence of claim 12 wherein the pickets rest upon the bottom rail and supports the top rail.

23. The fence of claim 12 wherein the pickets rest upon the bottom rail and covers the member aperture.

24. An apparatus including an assembled fence section comprising:

at least a first upper rail and a lower rail;

a plurality of pickets, wherein each picket of the plurality of pickets rests on the lower rail and extends into the first upper rail; and a plurality of strengthening members; wherein at least one strengthening member is positioned within and slideable relative to each of the plurality of pickets without rotating the at least one strengthening member and without disassembling any portion of the assembled fence section; and each slideable strengthening member extends past a lower end of a picket and into the lower rail.

25. An apparatus including an assembled fence section comprising:

at least a first upper rail, a second upper rail, and a lower rail;

a plurality of pickets, wherein each picket of the plurality of pickets rests on the lower rail and extends into the first upper rail;

at least one additional picket positioned above a lower picket that is one of the plurality of pickets, the at least one additional picket resting on the first upper rail and extending into the second upper rail; and a plurality of strengthening members; wherein at least one strengthening member is positioned within and slideable relative to each of the plurality of pickets without disassembling any portion of the assembled fence section;

each slideable strengthening member extends past a lower end of a picket and into the lower rail; and the strengthening member of the lower picket extends through the first upper rail and into the additional picket and is slideable relative to both the lower picket and the additional picket without disassembling any portion of the assembled fence section.

26. An apparatus including an assembled fence section comprising:

at least a first upper rail and a lower rail;

a plurality of pickets, wherein each picket of the plurality of pickets rests on the lower rail and extends into the first upper rail; and a plurality of strengthening members; wherein at least one strengthening member is positioned within and slideable relative to each of the plurality of pickets without disassembling any portion of the assembled fence section;

each slideable strengthening member extends past a lower end of a picket and into the lower rail; and the lower rail is elongated and comprises:

a cavity extending along the length of the lower rail; and a reinforcing member comprising a horizontal and substantially planar segment that each strengthening member rests upon but is not fastened to.

27. The apparatus of claim 26 wherein the cavity has a substantially rectangular cross section and the reinforcing member extends between two diagonally opposed corners of the cavity.

28. The apparatus of claim 26 wherein the lower rail is positioned vertically by sandwiching a dowel between the reinforcing member and a spacer comprising a U-shaped indentation receiving the dowel.

29. A method of assembling an apparatus including a section of fence, the section of fence including a plurality of vertical pickets with a strengthening member inside each picket of the plurality of pickets, at least a first upper rail and a lower rail, the upper rail comprising a plurality of picket apertures and the lower rail comprising a plurality of member apertures where the picket apertures are larger than the member apertures, the method comprising:

inserting a top end of each picket into a picket aperture of the upper rail and positioning each picket over a member aperture of the lower rail, with the strengthening member within each picket extending into the member aperture of the lower rail, and with the strengthening member slideable without being rotated within the picket; and completing assembly of the section of fence while keeping the strengthening member of each picket slideable within the picket.

30. A method of assembling an apparatus including a section of fence, the section of fence including a plurality of vertical pickets with a strengthening member inside each picket of the plurality of pickets, at least a first upper rail and a lower rail, the upper rail comprising a plurality of picket apertures and the lower rail comprising a plurality of member apertures where the picket apertures are larger than the member apertures, the method comprising:

inserting a top end of each picket into a picket aperture of the upper rail and positioning each picket over a member aperture of the lower rail, with the strengthening member within each picket extending into the a member aperture of the lower rail, and with the strengthening member slideable within the picket; and completing assembly of the section of fence while keeping the strengthening member of each picket slideable within the picket;

wherein the first upper rail comprises a plurality of member apertures on a side opposite and above the plurality of picket apertures, the method further comprising:

providing at least a second upper rail and positioning it above the first upper rail such that the first upper rail is a mid-rail positioned between the second upper rail and the lower rail;

providing a second plurality of vertical pickets, with each picket positioned above a picket in the first plurality of pickets, with the strengthening member of the lower picket extending through the mid-rail, at least partially into the upper picket, and into the second upper rail, and with the strengthening member slideable within the upper picket; and completing assembly of the section of fence while keeping the strengthening member of each picket slideable within the picket.

* * * * *